US009329528B2

(12) United States Patent
Noda

(10) Patent No.: US 9,329,528 B2
(45) Date of Patent: May 3, 2016

(54) IMAGE FORMING APPARATUS TO WHICH TONER CONTAINER CAPABLE OF CONTAINING TWO TONERS HAVING DIFFERENT MAGNETIC PERMEABILITIES IS CAPABLE OF BEING ATTACHED

(71) Applicant: KYOCERA Document Solutions Inc., Osaka (JP)

(72) Inventor: Tatsuo Noda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/812,343

(22) Filed: Jul. 29, 2015

(65) Prior Publication Data

US 2016/0033895 A1 Feb. 4, 2016

(30) Foreign Application Priority Data

Jul. 30, 2014 (JP) ..... 2014-155263

(51) Int. Cl.
*G03G 15/08* (2006.01)

(52) U.S. Cl.
CPC ..... *G03G 15/0865* (2013.01); *G03G 15/0829* (2013.01); *G03G 15/0853* (2013.01); *G03G 2215/0888* (2013.01)

(58) Field of Classification Search
CPC ..... G03G 15/0831; G03G 15/0865; G03G 15/0829; G03G 15/0853; G03G 2215/0888
USPC ..... 399/27, 30, 63
See application file for complete search history.

(56) References Cited

U.S. PATENT DOCUMENTS

| | | | | |
|---|---|---|---|---|
| 4,862,213 | A * | 8/1989 | Ichihara | G03G 13/09 399/259 |
| 4,912,512 | A * | 3/1990 | Midorikawa | G03G 15/08 399/12 |
| 7,212,752 | B2 * | 5/2007 | Hirota | G03G 15/0853 399/27 |
| 7,962,070 | B2 * | 6/2011 | Takeshita | G03G 9/107 399/258 |
| 9,104,160 | B2 * | 8/2015 | Yotsutsuji | G03G 13/06 |
| 2011/0318024 | A1 * | 12/2011 | Kawaguchi | G03G 15/0856 399/27 |

FOREIGN PATENT DOCUMENTS

| | | | |
|---|---|---|---|
| JP | 58035566 | A * | 3/1983 |
| JP | 59049554 | A * | 3/1984 |
| JP | 06161149 | A * | 6/1994 |
| JP | 2012-032736 | A | 2/2012 |

* cited by examiner

*Primary Examiner* — Robert Beatty
(74) *Attorney, Agent, or Firm* — Studebaker & Brackett PC

(57) ABSTRACT

An image forming apparatus includes a development section, a toner replenishment section, a toner sensor, and a determination section. The new toner container is filled with first and second toners that have different magnetic characteristics. The new container supplies the first toner to the toner replenishment section prior to the second toner. The determination section determines replacement of an existing toner container by a new one upon the output value of the toner sensor changing from a value out of a first-toner output value range to a value therewithin. The first-toner output value range is a range of an output value of the toner sensor in response to the magnetic characteristic of the first tone.

5 Claims, 8 Drawing Sheets

IMAGE FORMING APPARATUS TO WHICH TONER CONTAINER CAPABLE OF CONTAINING TWO TONERS HAVING DIFFERENT MAGNETIC PERMEABILITIES IS CAPABLE OF BEING ATTACHED

INCORPORATION BY REFERENCE

The present application claims priority under 35 U.S.C. §119 to Japanese Patent Application No. 2014-155263, filed Jul. 30, 2014. The contents of this application are incorporated herein by reference in their entirety.

BACKGROUND

The present disclosure relates to toner containers and image forming apparatuses.

An electrographic image forming apparatus such as a multifunction peripheral, a copier, a printer, or a facsimile machine performs printing using toner. A toner container, which may be called a toner housing or a toner cartridge, is attached to the image forming apparatus in a replaceable manner. The toner container contains toner for replenishing toner consumed by printing. When emptied, the toner container is replaced by a new one. An example of an image forming apparatus including such a replaceable toner container has been disclosed.

Specifically, the disclosed image forming apparatus includes an attachable and detachable toner container, a toner storage section (a sub-hopper), a developing device, and a driving power supply. The toner storage section receives toner supply from the toner container attached to the main body of the image forming apparatus. The developing device receives toner supply from the toner storage section. In response to drive of the driving power supply, toner is replenished so that the amount of toner in the toner storage section is a predetermined set amount and so that the toner density set in the developing device is a predetermined parameter value. For example, when the driving power supply is driven and the amount of toner in the toner storage section is accordingly not greater than the predetermined set amount, the parameter value of the toner density set in the developing device is smaller than a normal value. Upon detection of toner in the toner storage section being greater than the predetermined amount in a situation in which there is a possibility of detachment and attachment of a toner container, it is determined that the toner container is replaced by a new one and the parameter value of the toner density in the developing device is changed to the normal value. In the above configuration, detection of an increase in amount of toner in the toner storage section serves as a criterion for determining replacement of the toner container by a new one. This can enable detection of replacement of the toner container by a new one without need of any IC chip and eliminate the need of separation of electronic components from a container main body in disposal of the toner container.

SUMMARY

An image forming apparatus according to the present disclosure includes a development section, a toner replenishment section, a toner sensor, and a determination section. The development section develops an electrostatic latent image using toner. The toner replenishment section receives toner supply from a toner container and conveys received toner toward the development section. The toner sensor outputs a value that varies depending on an amount of a toner remaining in the toner replenishment section and a magnetic characteristic of the toner. The determination section determines according to an output value of the toner sensor whether or not an existing toner container is replaced by a new toner container. The new toner container is filled with a first toner and a second toner that have different magnetic characteristics. Once attached to the image forming apparatus, the new toner container supplies the first toner to the toner replenishment section prior to the second toner and the toner sensor outputs an output value within a first-toner output value range that is a range of an output value of the toner sensor in response to the magnetic characteristic of the first toner. Upon the output value of the toner sensor changing from a value out of the first-toner output value range to a value within the first-toner output value range, the determination section determines replacement of the existing toner container by the new toner container.

A toner container according to the present disclosure is filled with a first toner and a second toner that have different magnetic characteristics and are present as two layers.

DETAILED DESCRIPTION

Configuration, arrangement, etc. of elements disclosed in the following embodiments of the present disclosure should not be taken to limit the scope of the present disclosure and are mere examples for explanation.

With reference to FIGS. 1-10, a multifunction peripheral 100 as an example of an image forming apparatus will be described according to embodiments of the present disclosure. The multifunction peripheral 100 has a plurality of functions for various types of jobs including a printing function using toner (a copy function and a printing function), a scan function, a transmission function, etc.

(Configuration of Multifunction Peripheral 100).

First of all, a configuration of the multifunction peripheral 100 according to the present embodiment will be described with reference to FIG. 1.

Figure 1:
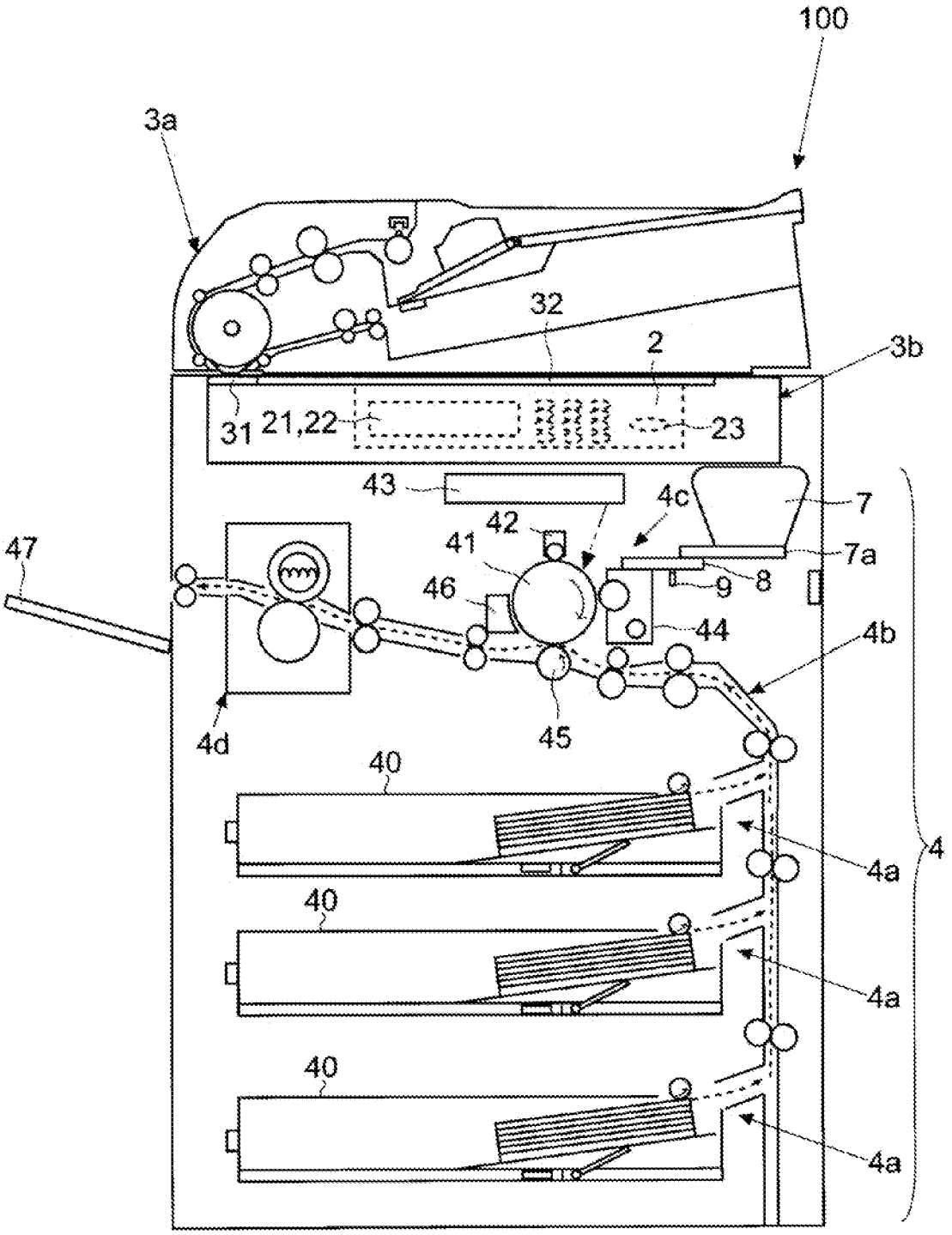
FIG. 1 illustrates a configuration of a multifunction peripheral.

As illustrated in FIG. 1, the multifunction peripheral 100 according to the present embodiment includes an operation panel 2 located on one side thereof. The multifunction peripheral 100 includes a document conveyance section 3*a* and an image reading section 3*b* in an upper part thereof and a printing section 4 that performs printing in the interior thereof. The printing section 4 includes a paper feed section 4*a*, a conveyance section 4*b*, an image forming section 4*c*, and a fixing section 4*d*.

The operation panel 2 includes a display section 21 (corresponding to an output section) that displays a state of the multifunction peripheral 100, various types of messages, and a setting screen. The display section 21 is a panel that performs display such as a liquid crystal panel or an organic EL panel. The display section 21 includes a touch panel 22. The operation panel 2 also includes a hard key group 23 for input such as a numeric keypad. A given operation on the hard key group 23 or the touch panel 22 causes the display section 21 to display a remaining toner level.

The document conveyance section 3*a* conveys a loaded original document to a reading point (fed document reading contact glass 31) on a sheet-by-sheet basis. The image reading section 3*b* irradiates with light an original document passing over the fed document reading contact glass 31 or an original document loaded on the loaded document reading contact glass 32. The image reading section 3*b* then reads the original document to generate image data of the original document.

The paper feed section 4*a* includes a plurality of cassettes 40. Paper is fed on a sheet-by-sheet basis from any one of the cassettes 40. The conveyance section 4*b* conveys the paper fed from the paper feed section 4*a* to the image forming section 4*c*. The image forming section 4*c* includes a photosensitive drum 41, a charger 42, an exposure section 43, a development section 44, a transfer roller 45, and a cleaning section 46. The photosensitive drum 41 is surrounded by the charger 42, the exposure section 43, the development section 44, the transfer roller 45, and the cleaning section 46. The image forming section 4*c* forms an electrostatic latent image based on the image data onto the photosensitive drum 41. The development section 44 develops the electrostatic latent image using toner. Note that a toner cartridge 7 (corresponding to a toner container) for toner supply to the development section 44 is attached in the main body of the multifunction peripheral 100. The fixing section 4*d* applies heat and pressure to the toner image transferred to the paper by the transfer roller 45 for fixing. The paper ejected from the fixing section 4*d* is ejected onto the exit tray 47.

(Hardware Configuration of Multifunction Peripheral 100).

A hardware configuration of the multifunction peripheral 100 according to the embodiment will be described next with reference to FIG. 2.

Figure 2:
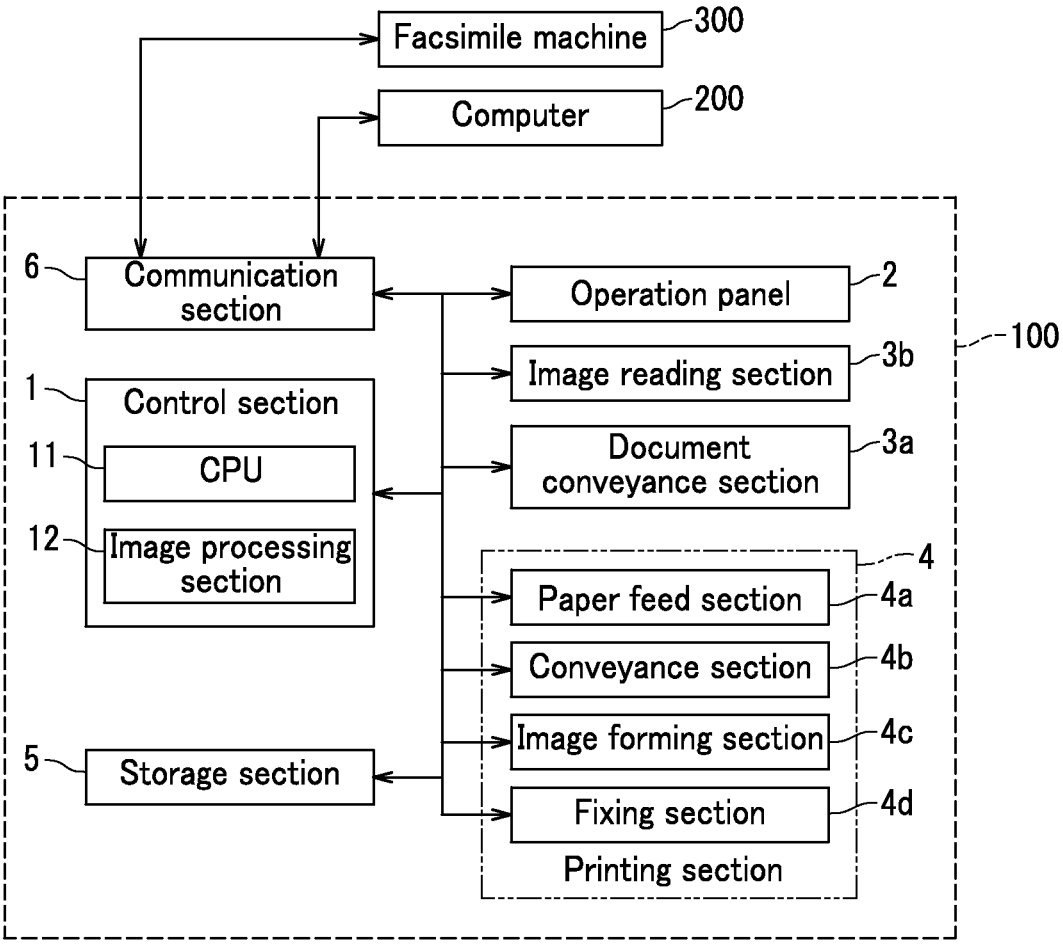
FIG. 2 is a block diagram illustrating a hardware configuration of the multifunction peripheral.

As illustrated in FIG. 2, the multifunction peripheral 100 according to the present embodiment further includes a control section 1 (corresponding to a determination section) and a storage section 5. The control section 1 includes a CPU 11 that performs various types of arithmetic processing, and an image processing section 12 that performs image processing on image data. The CPU 11 is a central processing unit and performs control and processing on various sections of the multifunction peripheral 100 based on control programs, control data, setting data, etc. The storage section 5 is a combination of non-volatile and volatile storage devices including a read only memory (ROM), a random access memory (RAM), a flash ROM, a hard disc drive (HDD), etc. The storage section 5 stores the control programs, the control data, and any other data. The storage section 5 will be described later in detail.

The control section 1 is connected to the operation panel 2, etc., recognizes a setting set through the operation panel 2, and controls display of the display section 21. The control section 1 is connected to a communication section 6. The communication section 6 may be a communication interface, for example, and performs communication with a computer 200 (a personal computer or a server) and a facsimile machine 300 through a network, a cable, or a public line. The communication section 6 receives print data from the computer 200 and the facsimile machine 300. The print data includes image data for printing and setting data for printing.

The image processing section 12 performs according to settings, various types of image processing on image data of an original document read by the image reading section 3*b* and image data received from the computer 200 and the facsimile machine 300. In printing, the image processing section 12 performs image processing according to the setting set through the operation panel 2 to generate image data for printing. The image processing section 12 transmits the image data for printing to the exposure section 43. In response to receipt of the image data for printing, the exposure section 43 performs exposure by scanning to form an electrostatic latent image (a copy function, a printing function, or a fax printing function).

The control section 1 is connected to the printing section 4 in a communicable manner. The control section 1 controls the printing section 4 to perform a printing operation. Note that the control section 1 may include a main control section and sub-control sections separated according to functions such as an engine control section. The main control section performs overall control on the multifunction peripheral 100, control for image processing, and communication control. The engine control section performs on/off control on a motor that rotates rotary members in printing, etc. and control for toner image formation.

(Toner Cartridge 7)

Figure 3:
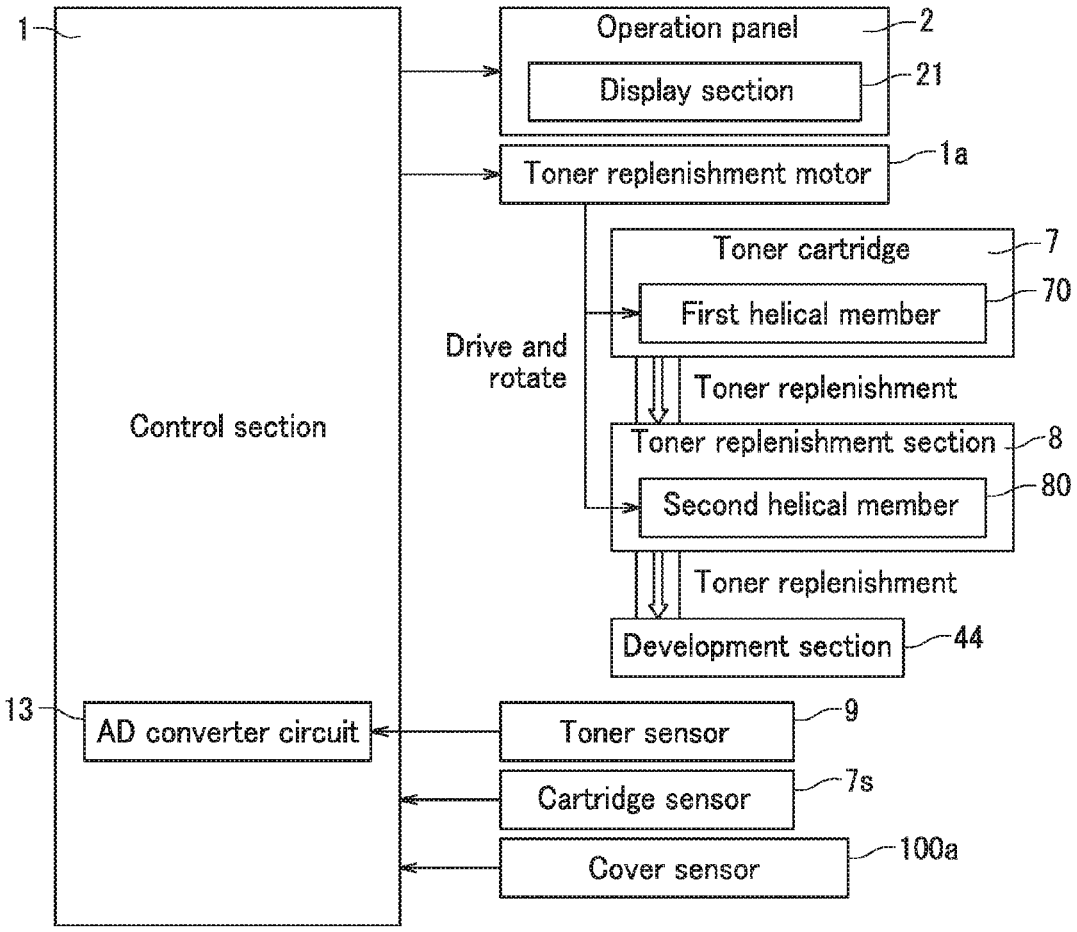
FIG. 3 illustrates a hardware configuration of a portion pertaining to toner replenishment in the multifunction peripheral.

The toner cartridge 7 will be described next with reference to FIGS. 1, 3, and 4.

The development section 44 develops an electrostatic latent image using toner to form a toner image. The development section 44 accordingly consumes the toner. In view of the foregoing, as illustrated in FIGS. 1, 3, and 4, the toner cartridge 7 (corresponding to a toner container) that contains a toner for supply to the development section 44 is attached to the multifunction peripheral 100 in a detachable manner. The toner cartridge 7 in the present embodiment contains a magnetic toner (a magnetic one-component toner). The toner cartridge 7 includes a connection portion 7*a* (a joint pipe) located at the lower part thereof. The connection portion 7*a* is tubular and connected to a toner replenishment section 8 included in the multifunction peripheral 100.

When a front cover (not illustrated) or a right wall cover (not illustrated) of the multifunction peripheral 100 is opened, the toner cartridge 7 is enabled to be attached and detached. The toner cartridge 7 is replaceable. A cartridge sensor 7*s* is arranged for detecting detachment and attachment of the toner cartridge 7, as illustrated in FIGS. 3 and 4. The cartridge sensor 7*s* changes its output between High and Low according to whether or not the toner cartridge 7 is attached. The control section 1 detects attachment and detachment of a toner cartridge 7 based on the output of the cartridge sensor 7*s*.

(Toner Replenishment from Toner Cartridge 7)

Description will be made next about members pertaining to toner replenishment and a basic process of toner replenishment in the present embodiment with reference to FIGS. 3 and 4. Note that a flow of the toner is indicated by white arrows in FIG. 4.

The toner replenishment section 8 is located in the interior of the main body of the multifunction peripheral 100. The toner replenishment section 8 conveys the toner in the toner cartridge 7 to the development section 44. In a situation in which the toner cartridge 7 is attached to the multifunction peripheral 100, a part of the connection portion 7*a* of the toner cartridge 7 (a left end part thereof in FIG. 4) overlaps with a part of the toner replenishment section 8 (a right end part thereof in FIG. 4 opposite to an end part thereof connected to the development section 44). As illustrated in FIG. 4, a lower surface of the part of the connection portion 7*a* overlapping with the toner replenishment section 8 has an opening, and an upper surface of the part of the toner replenishment section 8 overlapping with the connection portion 7*a* has an opening. The openings face each other to allow the toner in the toner cartridge 7 to be conveyed toward the toner replenishment section 8.

Figure 4:
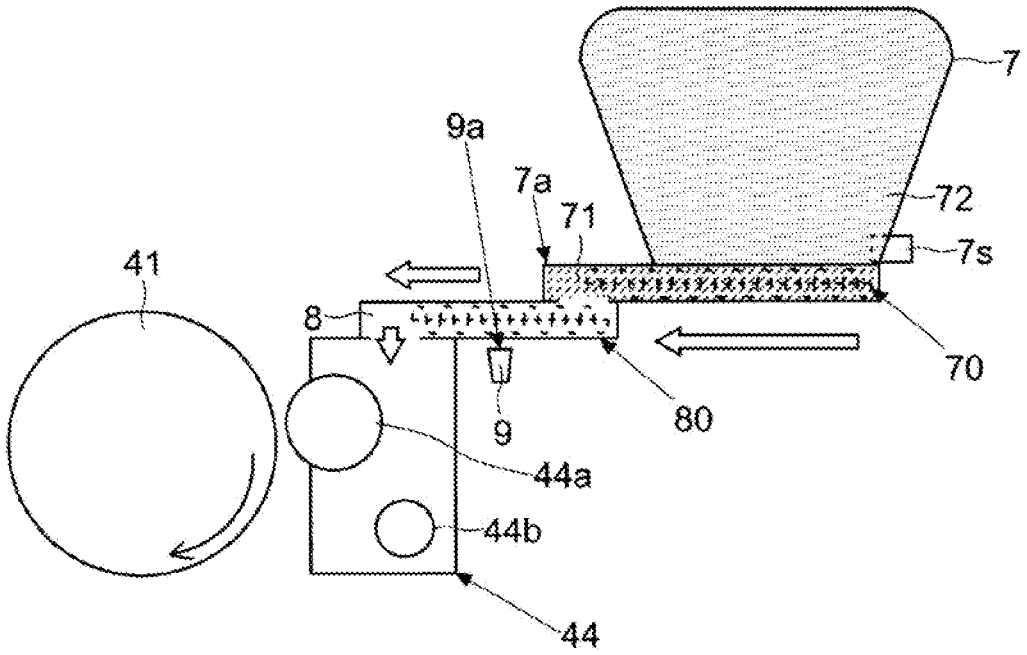
FIG. 4 is a diagram illustrating toner supply to a development section.

The upper surface of the box-shaped development section 44 overlaps with a part of the toner replenishment section 8 (a left end part thereof in FIG. 4). As illustrated in FIG. 4, the part of the development section 44 overlapping with the toner replenishment section 8 has an opening and a lower surface of the part of the toner replenishment section 8 overlapping with the development section 44 has an opening. The opening of the toner replenishment section 8 faces the opening of the development section 44 to allow the toner in the toner replenishment section 8 to be conveyed (fall in) to the development section 44.

A first helical member 70 is disposed in the interior of the connection portion 7*a*. The first helical member 70 includes a rotary shaft with a helical blade. Rotation of the first helical member 70 causes the toner in the toner cartridge 7 to be conveyed toward the toner replenishment section 8. The toner in the connection portion 7*a* then flows (falls) into the toner replenishment section 8. A second helical member 80 is disposed in the interior of the toner replenishment section 8. The second helical member 80 also includes a rotary shaft with a helical blade. Rotation of the second helical member 80 causes the toner in the toner replenishment section 8 to be conveyed toward the development section 44. The toner in the toner replenishment section 8 then flows (falls) into the development section 44.

The multifunction peripheral 100 includes a toner replenishment motor 1*a*. The toner replenishment motor 1*a* rotates the first and second helical members 70 and 80 in cooperation with a transmission gear. The control section 1 causes the toner replenishment motor 1*a* to rotate the first and second helical members 70 and 80 during a predetermined replenishment period for which the development section 44 is replenished with the toner. During the replenishment period, the toner in the toner cartridge 7 is conveyed toward the development section 44. Note that once the development section 44 is filled with toner, no more toner is conveyed to the development section 44, even though the first and second helical members 70 and 80 continue to rotate in order to stir the toner in the toner cartridge 7 and the toner replenishment section 8.

The replenishment period, in other words replenishment timing, can be determined appropriately. For example, the replenishment period may be a period between a start and an end of a print job. Alternatively, the replenishment period may be a given period starting from a time when the control section 1 detects (determines) detachment and attachment of the toner cartridge 7 based on an output of the cartridge sensor 7*s*. When an openable and closable cover (e.g., a front cover) of the multifunction peripheral 100 is opened, the toner cartridge 7 is enabled to be detached from and attached to the multifunction peripheral 100. The multifunction peripheral 100 additionally includes a cover sensor 100*a* that detects opening and closing of the cover (see FIG. 3). The cover sensor 100*a* changes its output between High and Low according to the cover being opened or closed. The control section 1 detects opening and closing of the cover according to the output of the cover sensor 100*a*. Once detecting opening and closing of the cover, the control section 1 may cause the toner replenishment motor 1*a* to rotate for a predetermined period starting from detection of the opening and closing of the cover as the replenishment period. As a result, the toner in the toner cartridge 7 is conveyed toward the development section 44. Alternatively, the replenishment period may be a predetermined period starting from a power-up of the main power supply or a change to a normal mode from an energy saving mode in the multifunction peripheral 100.

Note that the development section 44 includes a development roller 44*a*. The development roller 44*a* is located opposite to the photosensitive drum 41 and rotates while bearing a thin toner layer in development. The development section 44 further includes therein a stirring screw 44*b* that rotates to stir the toner in the development section 44.

A toner sensor 9 is arranged at a position corresponding to the toner replenishment section 8. The toner sensor 9 is a magnetic permeability sensor. For example, the toner sensor 9 includes therein a transformer. The toner sensor 9 is located at a lower part of the toner replenishment section 8. The toner sensor 9 has a detection surface 9*a* that faces upward to face the toner replenishment section 8. Output of the toner sensor 9 is input to the control section 1. The control section 1 includes an AD converter circuit 13 and recognizes an output value of the toner sensor 9.

The absolute value of the output value of the toner sensor 9 is larger when a large amount of a substance having a large magnetic permeability is present in a region where the toner sensor 9 performs detection (a region around the sensor 9) than when a small amount of a substance having a small magnetic permeability is present therein. Specifically, the greater the amount of toner present in the toner replenishment section 8, the greater the absolute value of the output value of the toner sensor 9. The smaller the amount of toner present in the toner replenishment section 8, the smaller the absolute value of the output value of the toner sensor 9. In a situation in which the detected toner amounts are the same, the greater the magnetic permeability (characteristic) of the toner, the greater the absolute value of the output value of the toner sensor 9. The smaller the magnetic permeability (characteristic) of the toner, the smaller the absolute value of the output value of the toner sensor 9. The toner used in the multifunction peripheral 100 in the present embodiment is a magnetic toner containing magnetic powder. The control section 1 detects (recognizes) toner exhaustion in the toner cartridge 7 and replacement of the toner cartridge 7 by a new one according to an output value of the toner sensor 9, which will be described later in detail.

For example, the control section 1 recognizes the output value of the toner sensor 9 at a predetermined time, such as a time when an instruction to start a print job is input through the operation panel 2, a time when print data is received from the computer 200, a time when a print job is ended, a time when the main power supply of the multifunction peripheral 100 is turned on, or a time when the energy saving mode is changed to the normal mode. Alternatively, the control section 1 may recognize the output value of the toner sensor 9 periodically during the aforementioned replenishment period. In another example, the control section 1 may recognize the output value of the toner sensor 9 at predetermined regular intervals regardless of printing.

(Detection of Toner Exhaustion)

Detection of toner exhaustion will be described next with reference to FIGS. 5 and 6. Note that the first and second helical members 70 and 80 are not illustrated in FIG. 6 for convenience sake.

In a situation in which toner in the toner replenishment section 8 has a uniform magnetic characteristic (permeability), the output value of the toner sensor 9 in the multifunction peripheral 100 according to the present embodiment is smaller when the amount of the toner in the toner replenishment section 8 is small than when the amount of the toner in the toner replenishment section 8 is large, and is greater when the amount of the toner in the toner replenishment section 8 is large than when the amount of the toner in the toner replenishment section is small. In the multifunction peripheral 100 in the present embodiment, the toner is only stirred then without being conveyed, as described above. Accordingly, a state in which the output value of the toner sensor 9 is small means a state in which the amount of toner in the toner replenishment section 8 is small and no toner, or only a small amount of toner, is conveyed to the toner replenishment section 8 from the toner cartridge 7 (a state illustrated in the first diagram in FIG. 6). When printing is continued even in a situation in which the toner cartridge 7 is empty, the toner in the development section 44 is soon completely exhausted, disabling printing. For this reason, replacement of the empty toner cartridge 7 by a new toner cartridge 7 is necessary.

In view of the foregoing, the control section 1 detects the toner cartridge 7 being empty. Specifically, the control section 1 detects (recognizes) that the toner cartridge 7 is empty (toner exhaustion) upon the output value of the toner sensor 9 being a predetermined empty value Ve or less.

Detection of toner exhaustion will be described with reference to FIG. 5. The vertical axis and the horizontal axis in the graph representation of FIG. 5 represent the magnitude of the output value of the toner sensor 9 and time, respectively. The empty value Ve is indicated by a dashed and double dotted line in the graph representation of FIG. 5. When the output value of the toner sensor 9 is not greater than the empty value Ve (Te1 and Te2 in FIG. 5), the control section 1 detects (recognizes) the toner cartridge 7 being empty.

In response to detection of toner exhaustion, the control section 1 causes the display section 21 of the operation panel 2 to display a message or an image representing toner exhaustion (no toner). Also, even if a new instruction to execute a print job is received through the operation panel 2 or print data is received from the computer 200, the control section 1 may suspend a print start until the toner cartridge 7 is replaced and the toner replenishment section 8 is filled with toner after detection of toner exhaustion. The reason for the above is that image quality may degrade due to low image density of printed matter or members in the development section 44 may be damaged if printing is continued with no toner, or only a small amount of toner, remaining in the toner cartridge 7. Note that when toner exhaustion is detected in printing, the control section 1 may cause the printing section 4 to stop printing upon the detection or continue printing until a currently executed print job is completed.

(Detection of Replacement of Toner Cartridge 7 by New One)

Figure 5:
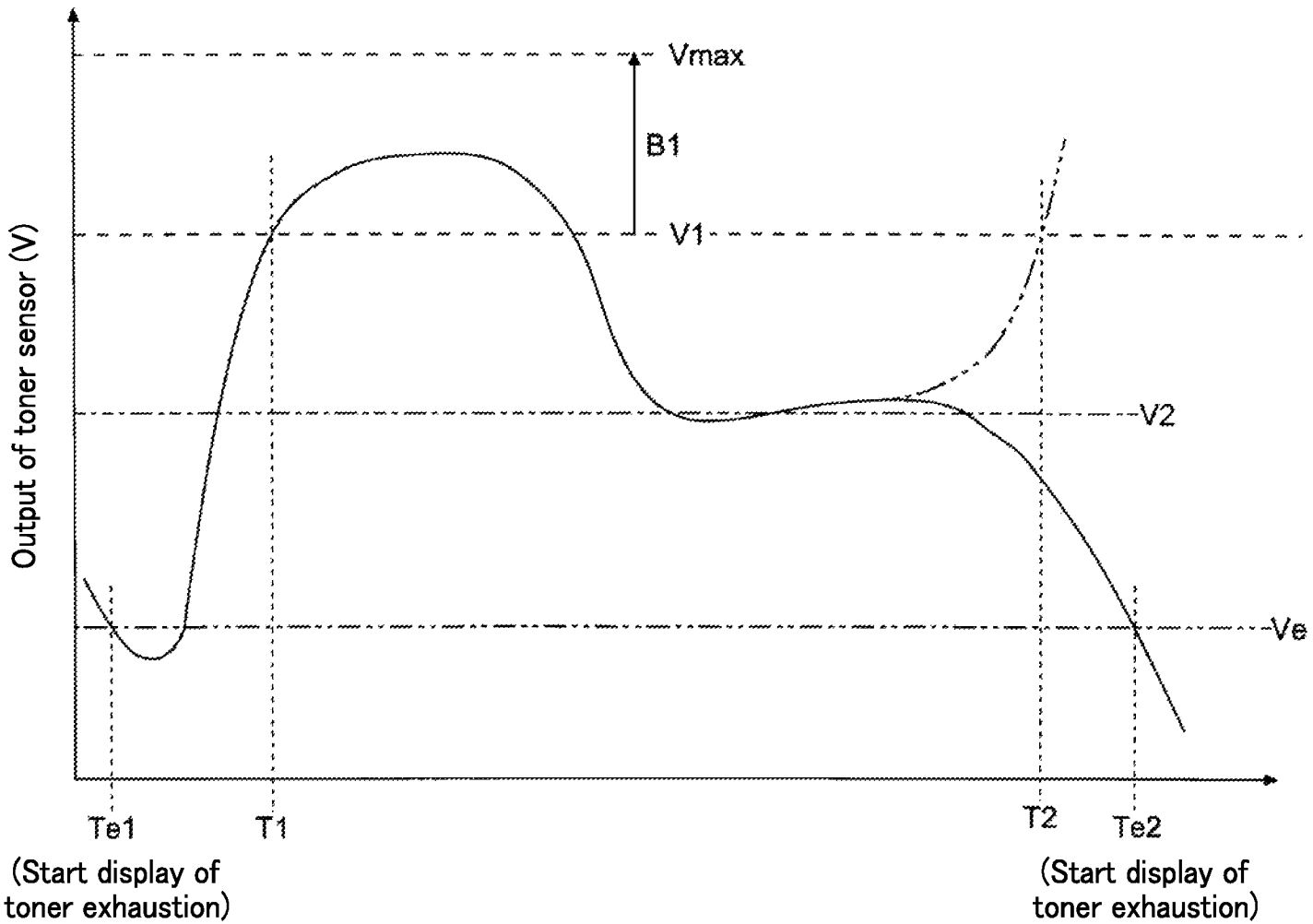
FIG. 5 is a graph representation indicating variation in output value of a toner sensor.
Figure 6:
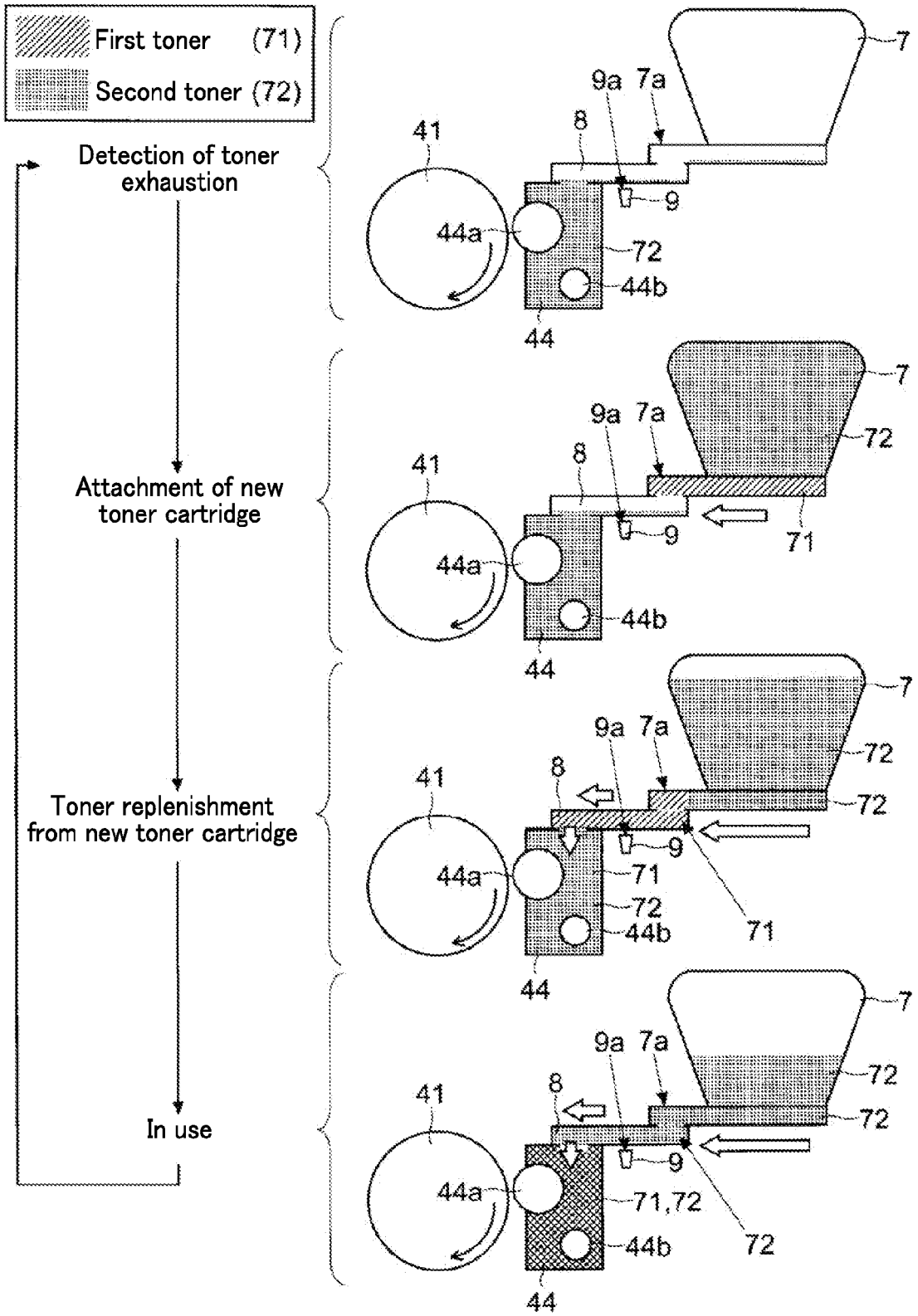
FIG. 6 is a diagram illustrating toner cartridge replacement and progress of toner consumption.
Figure 7:
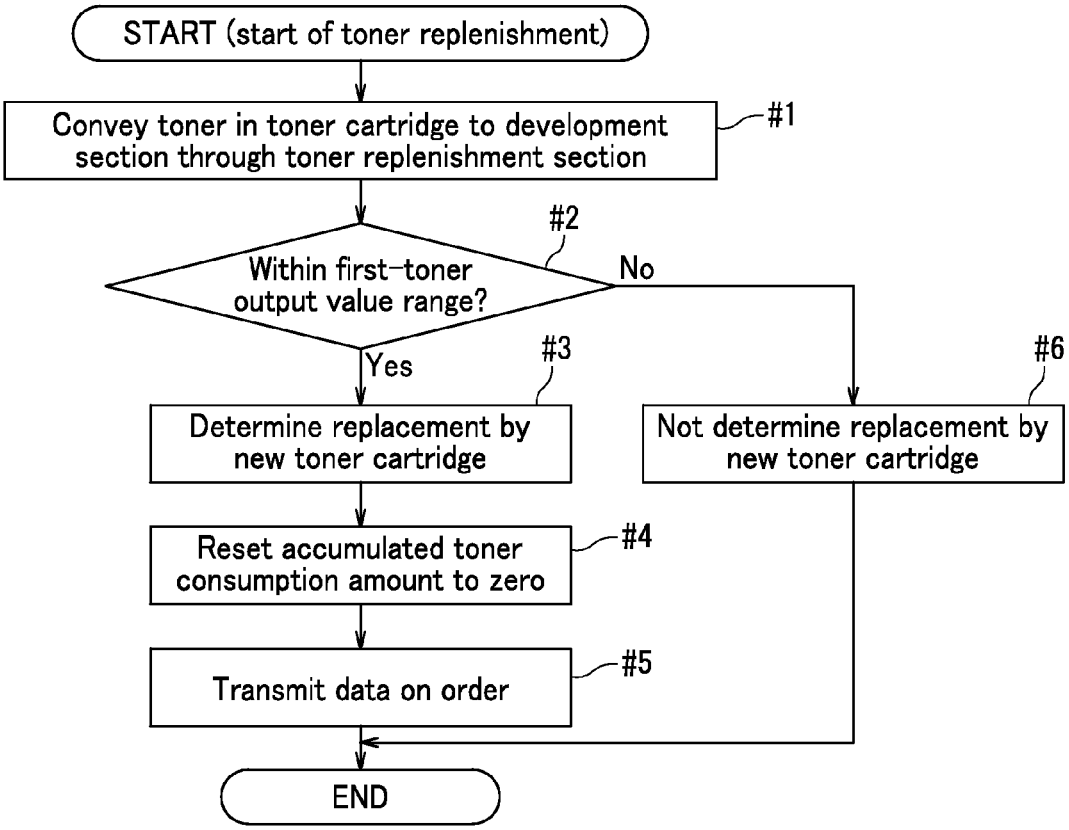
FIG. 7 is a diagram illustrating an example of a process for detection of replacement of a toner cartridge by a new one.

With reference to FIGS. 5, 6, and 7, detection of replacement of a toner cartridge 7 by a new toner cartridge 7 will be described next.

First, a process of toner consumption will be described with reference to FIG. 6. The first diagram in FIG. 6 illustrates one example of a state in which the control section 1 detects toner exhaustion. In the first (uppermost) diagram in FIG. 6, there is hardly any toner remaining in the toner replenishment section 8. The second diagram in FIG. 6 illustrates a state in which a new toner cartridge 7 is attached by replacing the empty toner cartridge 7 illustrated in the first diagram. The third diagram in FIG. 6 illustrates a state in which in response to detachment of the toner cartridge 7 and attachment of a new one, the control section 1 causes rotation of the first and second helical members 70 and 80 for toner supply from the newly attached toner cartridge 7 toward the development section 44 (a state in which the toner is replenished during the replenishment period). The fourth (lowermost) diagram in FIG. 6 illustrates an example of a state in which the toner is gradually supplied to the development section 44 after attachment of the new toner cartridge 7. When toner supply to the development section 44 is continued in the state illustrated in the fourth diagram in FIG. 6, the state progresses to the state illustrated in the first diagram in FIG. 6.

As illustrated in the second diagram in FIG. 6, the new toner cartridge 7 is filled with a first toner 71 and a second toner 72 that have different magnetic characteristics (magnetic permeabilities). The first toner 71 is different from the second toner 72 in type. Note that the first toner 71 is indicated by hatching and the second toner 72 is indicated by dots in FIG. 6.

For example, a new toner cartridge 7 is completely filled with the first and second toners 71 and 72. The connection portion 7*a* of the new toner cartridge 7 is only partially filled with the first toner 71. The second diagram in FIG. 6 illustrates an example in which the first toner 71 is present in the lower part of the toner cartridge 7, however, the first toner 71 may alternatively be present in only the tubular connection portion 7*a*. This can reduce mixture of the first toner 71 with the second toner 72 even when the toner cartridge 7 is shaken in conveyance.

The magnetic characteristics of the first and second toners 71 and 72 are such that the toner sensor 9 outputs a greater output value in response to the magnetic characteristic of the first toner 71 than in response to the magnetic characteristic of the second toner 72. Specifically, the first and second toners 71 and 72 are manufactured to have magnetic permeabilities that makes the output value of the toner sensor 9 greater when the first toner 71 is present in the toner replenishment section 8 than when the second toner 72 is present therein. For example, the amount of the magnetic powder contained in the first toner 71 is greater than that of the magnetic powder contained in the second toner 72. Alternatively, the first and second toners 71 and 72 may have different magnetic permeabilities by differentiating materials of the magnetic powder between the first and second toners 71 and 72 while the amounts per unit volume of the magnetic powder are the same in the first and second toner 71 and 72. Note that the first and second toners 71 and 72 have different magnetic characteristics, but there is no difference in printing characteristics therebetween (no significant difference is involved between the first and second toners 71 and 72 in printing).

With reference to FIG. 7, description will be made next about a control process performed in response to attachment of a new toner cartridge 7. The control process in FIG. 7 starts when the control section 1 recognizes replacement (attachment and detachment) of a toner cartridge 7 according to an output value of the cartridge sensor 7*s*, starts the replenishment period, and causes replenishment to start.

When the toner cartridge 7 is replaced by a new toner cartridge 7, the control section 1 causes the toner replenishment motor 1*a* to rotate for rotation of the first and second helical members 70 and 80, thereby causing continuous operation for conveyance of the toner in the toner cartridge 7 toward the toner replenishment section 8 and the development section 44 for a predetermined period (continuous replenishment during the replenishment period at Step #1). A duration of the replenishment period for replenishment in replacement is set long enough to change the state of the development section 44 and the toner replenishment section 8 from toner exhaustion to a toner filled state after a new toner cartridge 7 is attached. The duration of the replenishment period for replenishment in replacement is determined in view of toner conveyance capacity of each of the first and second helical members 70 and 80.

The control section 1 recognizes the output value of the toner sensor 9 during the replenishment period and recognizes whether or not the output value of the toner sensor 9 changes from a value out of a first-toner output value range B1 to a value within the first-toner output value range B1 (Step #2). Note that the value out of the first-toner output range B1 may be less than or equal to the empty value Ve.

Once a new toner cartridge 7 is attached, the new toner cartridge 7 supplies (conveys) the first toner 71 to the toner replenishment section 8 prior to the second toner 72. Then, when the output value of the toner sensor 9 changes from a value out of the first-toner output value range B1 to a value within the first-toner output value range B1 (Yes at Step #2), the control section 1 determines that the toner cartridge 7 is replaced by a new toner cartridge 7 (Step #3). In other words, when the output value of the toner sensor 9 changes from a value out of the first-toner output value range B1 (e.g., a value indicating toner exhaustion) to a value greater than a first threshold value V1, the control section 1 determines that the toner cartridge 7 is replaced by a new toner cartridge 7. In FIG. 5, T1 represents a time when the control section 1 determines replacement of the toner cartridge 7 by a new one.

The first-toner output value range B1 will now be described with reference to FIG. 5. The toner sensor 9 outputs a greater output value in response to the magnetic characteristic of the first toner 71 than in response to the magnetic characteristic of the second toner 72. For this reason, as illustrated in FIG. 5, the output value (the absolute value thereof) of the toner sensor 9 is greater in a state in which the toner replenishment section 8 is filled with the first toner 71 (a state illustrated in the third diagram of FIG. 6) than in a state in which the toner replenishment section 8 is filled with the second toner 72, and also than in a state in which only a small amount of toner remains in the toner replenishment section 8 in toner exhaustion.

In the above configuration, the output value of the toner sensor 9 is the greatest in a situation in which the toner sensor 9 detects the first toner 71. Accordingly, the first-toner output value range B1 is set to include values greater than the predetermined first threshold value V1 that is a lower limit value of the first-toner output value range B1. Note that an upper limit value of the first-toner output value range B1 may be a maximum output value Vmax of the toner sensor 9. The first-toner output value range is represented by B1 in FIG. 5.

Note that the first and second toners 71 and 72 have different magnetic characteristics. For this reason, the output value is out of the first-toner output value range B1 even in a state in which the control section 1 does not detect toner exhaustion in the toner cartridge 7 due to the presence of the second toner 72 in the toner replenishment section 8. In FIG. 5, a standard output value of the toner sensor 9 when the second toner 72 is present in the toner replenishment section 8 is represented as a second threshold value V2.

The control section 1 can detect replacement of the toner cartridge 7 by a new one once toner cartridge replacement causes the output value of the toner sensor 9 to be within the first-toner output value range B1 (not less than the first threshold value V1), even in a situation in which the second toner 72 is present in the toner replenishment section 8 (the output value of the toner sensor 9 is around the second threshold value V2) when replacement occurs. In other words, detection of the development section 44 or a toner hopper containing no toner, or only a small amount of toner, does not correspond to detection (determination) of replacement of the toner cartridge 7 by a new one.

Referring to FIG. 5, a dashed and three dotted line indicates an example of variation in output value of the toner sensor 9 when the toner cartridge 7 is replaced by a new one in a state in which the second toner 72 is present in the toner replenishment section 8. Reference sign T2 in FIG. 5 indicates a time when the output value is greater than the first threshold value V1 and the control section 1 accordingly determines replacement of the toner cartridge 7 by a new one.

Referring to FIG. 7, description will be continued about the control process in attachment of a new toner cartridge 7. The control section 1 resets an accumulated toner consumption amount 51 indicating the amount of toner consumed in the currently attached toner cartridge 7 to zero, which will be described later in detail (Step #4). Additionally, for example, the control section 1 may cause the communication section 6 to transmit information on a purchase order for a new toner cartridge 7 to a predetermined address of a transmission target 400, which will be described later in detail (Step #5). In other words, replacement of the toner cartridge 7 by a new one may serve as a trigger to cause the control section 1 to cause the communication section 6 to transmit information on a purchase order for a new toner cartridge 7. The above configuration can prevent a situation from arising in which a new toner cartridge 7 is not ordered until after the attached toner cartridge 7 is empty. The control process then is ended (END).

By contrast, in a situation in which the output value of the toner sensor 9 remains out of the first-toner output value range B1 (No at Step #2), the control section 1 does not determine replacement of the toner cartridge 7 by a new one (Step #6). Then, the control process is ended.

Printing is disabled due to toner exhaustion. In this situation, a user may detach a toner cartridge 7 from another image forming apparatus that uses an identical toner cartridge 7 to that of the multifunction peripheral 100 and attach it to the multifunction peripheral 100 in order to combat toner exhaustion. By doing so, attachment and detachment of the toner cartridges 7 may cause the toner replenishment motor 1*a* to operate for conveyance of toner contained in the temporarily attached toner cartridge 7 toward the toner replenishment section 8, thereby filling the toner replenishment section 8 with some amount of the second toner 72. The output value of the toner sensor 9 accordingly changes from a value not greater than the empty value Ve to a value around the second threshold value V2 but remains out of the first-toner output value range B1. Therefore, the control section 1 does not determine replacement of the toner cartridge 7 by a new one. In the above configuration, even when a non-new toner cartridge 7 is attached to the multifunction peripheral 100 (image forming apparatus) in a state of toner exhaustion for toner replenishment, mis-detection of replacement of a toner cartridge 7 by a new one can be prevented. Note that toner is replenished from the non-new toner cartridge 7 in this case, and therefore, print stop due to toner exhaustion may be removed and indication of a message or the like requesting toner cartridge replacement may be deleted.

(Storage of Toner Consumption Amount and Indication of Remaining Toner Level)

Figure 8:
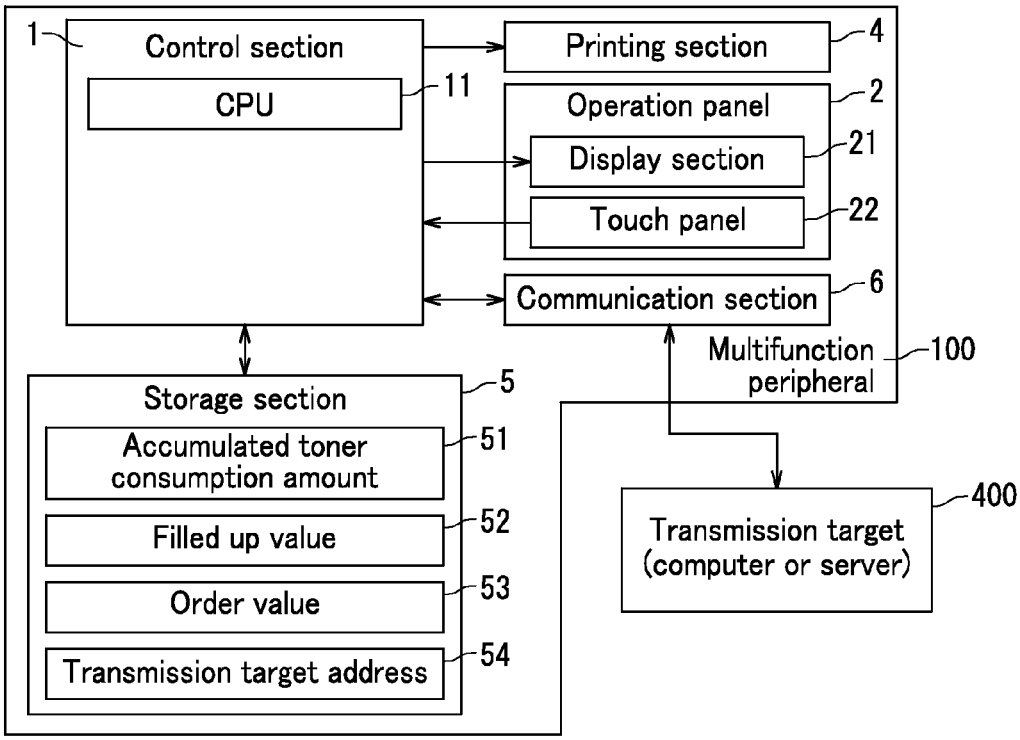
FIG. 8 is a diagram illustrating storage of an accumulated amount of toner consumption and indication of a remaining toner level.
Figure 9:
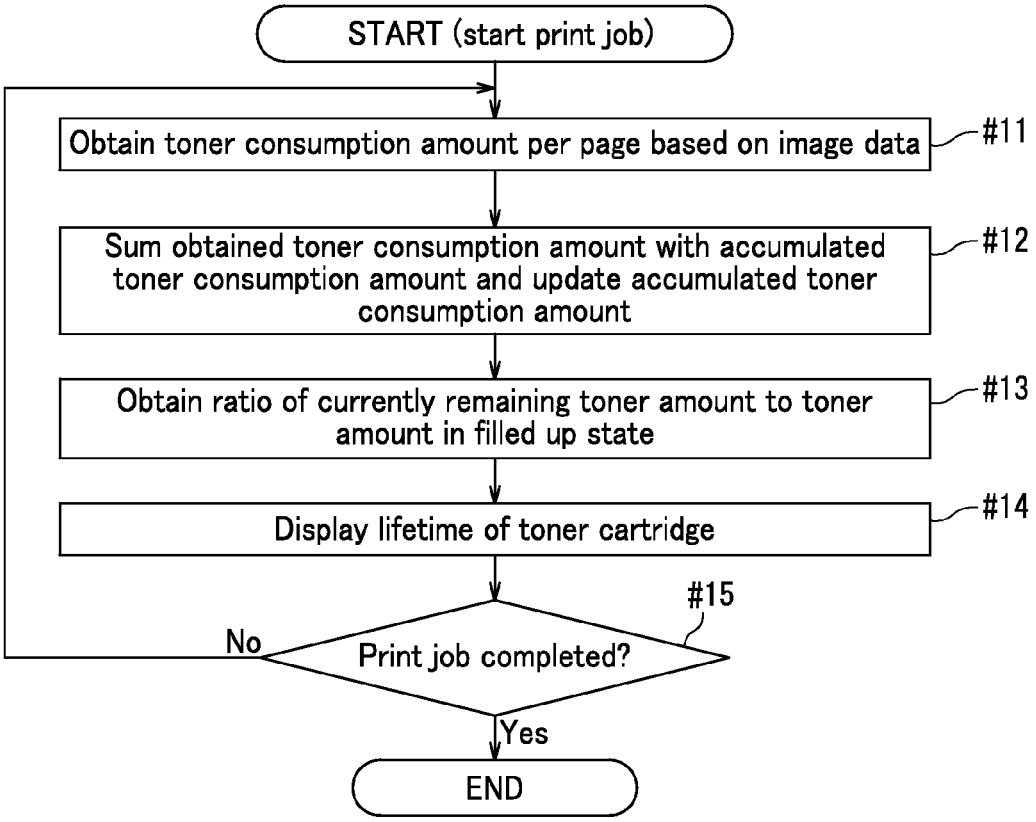
FIG. 9 is a flowchart depicting an example of a process for calculation of an accumulated amount of toner consumption and indication of a remaining toner level.
Figure 10:
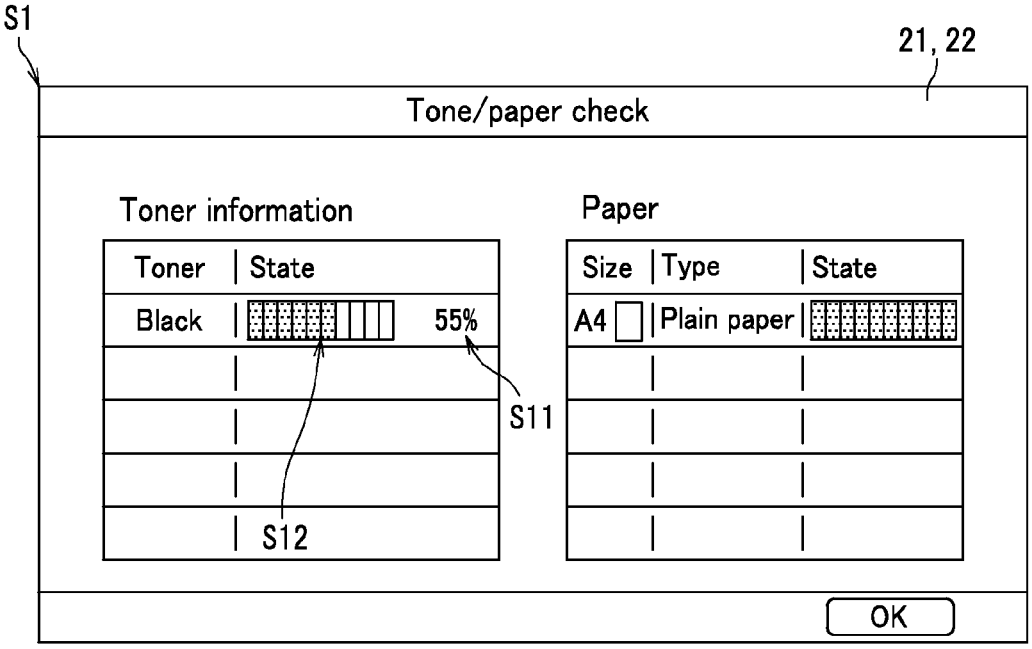
FIG. 10 illustrates an example of a remaining toner level display screen S1.

With reference to FIGS. 8-10, description will be made about storage of an amount of toner consumption accumulated since replacement of the toner cartridge 7 by a new one (hereinafter referred to as an accumulated toner consumption amount 51) and indication of a remaining toner level.

Conventionally, in order to store individual information such as a type, a manufacturing site, a serial number, etc. of a toner cartridge 7 and an amount of consumed toner, a non-volatile storage device (storage circuit) such as an IC chip or an electrically erasable programmable read-only memory (EEPROM) may be mounted on the toner cartridge 7. However, such a non-volatile storage device is not mounted on the toner cartridge 7 in the present embodiment, which differs from the conventional one.

The storage section 5 of the multifunction peripheral 100 in the present embodiment stores data indicating the accumulated toner consumption amount 51, as illustrated in FIG. 8, in a non-volatile manner. As described above, the control section 1 causes the storage section 5 to reset the accumulated toner consumption amount 51 upon determining replacement of the toner cartridge 7 by a new one. Mis-detection of replacement of the toner cartridge 7 by a new one can be prevented in the present embodiment even in a situation in which a non-new toner cartridge 7 is attached. As a result, the accumulated toner consumption amount 51 can be reliable. Thus, an accurate result of estimation relating to the lifetime of a new toner cartridge 7 (a remaining toner level) can be indicated according to the reliable accumulated toner consumption amount 51.

An example of a process of calculation of an amount of toner consumption and indication of a remaining toner level will be described with reference to FIG. 9. The process in FIG. 9 starts at a start of a print job.

First, the control section 1 obtains an amount of toner consumption on a page to be printed from the current time (or printed page) based on image data about the page (Step #11). For example, the control section 1 counts the number of pixels in the page on which toner is loaded among all pixels (dots) per page based on the image data. The control section 1 then multiplies the counted value by a predetermined toner consumption amount per one dot to obtain a toner consumption amount in the page. Alternatively, the control section 1 may obtain the toner consumption amount in the page in a manner that an average density or printing rate per page is obtained based on the image data and the obtained average density or printing rate is multiplied by a toner consumption amount per 1% of the predetermined density or printing rate. The toner consumption amount per one dot and that per 1% can be determined in advance according to an experiment or the like.

The control section 1 adds (sums) the obtained toner consumption amount per page and the accumulated toner consumption amount 51 up to the present (an accumulated toner consumption amount 51 from replacement of the toner cartridge 7 by a new one) and causes the storage section 5 to update the accumulated toner consumption amount 51 (Step #12). In this manner, the control section 1 causes the accumulated toner consumption amount 51 to be updated each time printing is performed. The control section 1 then obtains a ratio of the currently remaining toner amount to a toner amount in the toner filled state (Step #13).

Specifically, the amount of toner present in the toner cartridge 7 in the toner filled state is fixed. A value indicating the amount of toner in the toner filled state (a filled up value 52) is stored in the storage section 5 in advance (see FIG. 8). The control section 1 obtains a remaining toner amount indicating the amount of currently remaining toner by subtracting the accumulated toner consumption amount 51 from the filled up value 52 and divides the remaining toner amount by the filled up value 52, thereby obtaining a ratio of the currently remaining toner amount.

The control section 1 causes the display section 21 to perform display relating to the lifetime of the toner cartridge 7 (a remaining amount level) based on the obtained ratio (Step #14).

With reference to FIG. 10, a specific example of indication of a remaining toner level will be described below. FIG. 10 illustrates an example of a remaining toner level display screen S1 displayed on the display section 21 of the operation panel 2. In response to a user operation for causing indication of a level of toner remaining in the toner cartridge 7, the control section 1 causes the display section 21 to display the remaining toner level display screen S1 as illustrated in FIG. 10. Note that the control section 1 may cause the display section 21 to always indicate a remaining toner level at an end part or a region displaying a message in the display section 21.

The control section 1 causes the remaining toner level display screen S1 to indicate a level of the toner remaining in the toner cartridge 7, as illustrated in FIG. 10. The control section 1 causes the remaining toner level display screen S1 to display numerals S11 that indicates a ratio (obtained ratio) of the currently remaining toner amount to the toner amount in the toner filled state on a percentage basis, and a toner level indicator S12. In the example illustrated in FIG. 10, the control section 1 causes display of ten segments (10% per one segment) in the toner level indicator S12. The control section 1 causes the display section 21 to display segments in a hatched manner from the left as a barometer of the remaining toner level. The number of the hatched segments corresponds to a value obtained by multiplying the obtained ratio by 10 and rounding off, up, or down a value after the decimal point of the multiplied ratio. The other segments are indicated white.

Subsequently, the control section 1 confirms whether or not the print job is completed (whether or not any pages of which toner consumption amount is to be added to (summed with) the accumulated toner consumption amount 51 is present yet in the print job) (Step #15). When any page for which the toner consumption amount per page is not yet obtained in the print job and the print job is not completed (No at Step #15), the flow returns to Step #11. By contrast, when each toner consumption amount per page has been already obtained and no page of which toner consumption amount is to be added (summed) is present (Yes at #15), the flow is ended (END).

(Transmission of Data on Purchase Order)

Referring to FIG. 8, transmission of data on a purchase order for a toner cartridge 7 will be described next.

If no toner cartridge 7 is present in hand when toner exhaustion is detected, printing is disabled until a new toner cartridge 7 is obtained. A new toner cartridge 7 is not necessarily obtained immediately. In order to prevent the above inconvenience, it can be considered that in response to replacement of a toner cartridge 7 by a new one being detected in an image forming apparatus, a purchase order for a new toner cartridge 7 is automatically issued to a distributor of the toner cartridge 7.

However, there may be a case in a conventional image forming apparatus in which detachment and attachment of a non-new toner cartridge 7 is mis-determined as replacement of the toner cartridge 7 by a new one. If automatic issuance of a purchase order for a new toner cartridge 7 is made each time replacement of a newly-attached toner cartridge is detected, the number of ordered toner cartridges 7 may be greater than the number of necessary toner cartridges 7 before a user notices. For example, suppose that an act of bringing a toner cartridge 7 from another image forming apparatus and attaching it to the multifunction peripheral 100 is repeated plural times and replacement of the toner cartridge 7 by a new one is mis-detected upon each detection of toner exhaustion. If a purchase order for a toner cartridge 7 is issued automatically each time replacement is mis-detected, a purchase order for a toner cartridge 7 is issued repeatedly by the number of repetitions of mis-detection even though an order for only one toner cartridge 7 may suffice.

By contrast, the control section 1 in the multifunction peripheral 100 in the present embodiment can determine replacement of the toner cartridge 7 by new one correctly. In the above configuration, determination of replacement of the toner cartridge 7 by a new one by the control section 1 necessarily means use of only one new toner cartridge 7 that is stocked. Accordingly, in the multifunction peripheral 100 according to the present embodiment, excessive order issuance for a new toner cartridge 7 can be prevented even when a purchase order for a new toner cartridge 7 is automatically issued in response to toner cartridge replacement.

Specifically, as illustrated in FIG. 8, the multifunction peripheral 100 includes a communication section 6 that transmits data. When the remaining amount of toner in the toner cartridge 7 (remaining toner amount) reaches a predetermined order value 53, the control section 1 causes the communication section 6 to transmit order data on a purchase order for a new toner cartridge 7 to a predetermined transmission target 400.

The predetermined order value 53 can be determined appropriately herein. For example, the order value 53 can be set by inputting the order value 53 from the operation panel 2 or transmitting the order value 53 through a computer to the multifunction peripheral 100. The set order value 53 is stored in the storage section 5 in a non-volatile manner (see FIG. 8). The control section 1 causes the communication section 6 to transmit the order data when the amount of toner remaining in the toner cartridge 7 is equal to the order value 53.

For example, when procurement of a new toner cartridge 7 is desired immediately after replacement of the toner cartridge 7 by new one, the order value 53 is set so that transmission of the order data is caused in response to detection of replacement of the toner cartridge 7 by a new one. In this case, the order value 53 is set equal to the filled up value 52. In this situation, the accumulated toner consumption amount 51 is zero, and the filled up value 52 is equal to the remaining toner amount and the order value 53. In another example, if it is desired that a purchase order for a new toner cartridge 7 is issued when the amount of toner remaining in the toner cartridge 7 is less than 20% because printing frequency is not so high, the order value 53 may be set to be a value obtained by multiplying the filled state value 52 by 20%. In this case, the accumulated toner consumption amount 51 is obtained by multiplying the filled up value 52 by 80% and the remaining toner amount is equal to the order value 53 and the filled up value 52 multiplied by 20%.

Further, the order data may be in the form of a written order to a manufacturer or a distributor of the toner cartridge 7. In this case, the predetermined transmission target 400 may be a server or computer for ordering to the manufacturer or distributor of the toner cartridge 7. Alternatively, the order data may be in the form of notification to an orderer in charge of ordering equipment including the toner cartridge 7. In this case, a computer that the orderer uses for ordering serves as the transmission target 400 and informs the orderer that a time to order is approaching.

A transmission target address 54 of the order data can be set by input thereof through the operation panel 2 or transmission thereof to the multifunction peripheral 100 from a computer in which the transmission target address 54 is set. The set transmission target address 54 is stored in the storage section 5 in a non-volatile manner. The control section 1 then causes the communication section 6 to transmit the order data to the registered transmission target address 54 that has been set.

As has been discussed with reference to FIGS. 1-10, the image forming apparatus (multifunction peripheral 100) according to the present disclosure includes the development section 44, the toner replenishment section 8, the toner sensor 9, and the determination section (the control section 1). The development section 44 develops an electrostatic latent image using toner. The image forming apparatus (the multifunction peripheral 100) can accommodate the toner container (the toner cartridge 7). The toner container contains magnetic toner to be supplied to the development section 44 and is replaceable. The toner replenishment section 8 receives toner supply from the toner container and conveys received toner toward the development section 44. The toner sensor 9 outputs a value that varies depending on an amount of a toner remaining in the toner replenishment section 8 and a magnetic characteristic of the toner. The determination section determines according to an output value of the toner sensor 9 whether or not an existing toner container is replaced by a new toner container. The new toner container is filled with the first toner 71 and the second toner 72 that have different magnetic characteristics. Once attached to the image forming apparatus, the new toner container supplies the first toner 71 to the toner replenishment section 8 prior to the second toner 72 and the toner sensor 9 outputs an output value within a first-toner output value range B1 that is a range of an output value of the toner sensor in response to the magnetic characteristic of the first toner 71. Upon the output value of the toner sensor 9 changing from a value out of the first-toner output value range B1 to a value within the first-toner output value range B1, the determination section determines replacement of the toner cartridge by a new one.

In the above configuration, in response to replacement by a new toner container (toner cartridge 7), the first toner 71 is necessarily supplied to the toner replenishment section 8 prior to the second toner 72. Therefore, replacement of the toner container by a new one is only necessary when the output value of the toner sensor 9 changes to a value within the output value range corresponding to the range of an output value of the toner sensor 9 in response to the magnetic characteristic of the first toner 71. In the above configuration, simply monitoring the output value of the toner sensor 9 can enable correct detection of replacement of the toner container by a new toner container. Note that only one toner sensor 9 is disposed for detecting a toner amount, which can prevent an increase in manufacturing cost of the image forming apparatus (the multifunction peripheral 100). Correct detection and recognition of replacement of the toner container by a new can be achieved without need of an additional storage circuit such as an IC chip. Accordingly, in contrast to a conventional apparatus, it is unnecessary to provide a circuit or an element for communication with a storage circuit within the image forming apparatus (the multifunction peripheral 100), thereby reducing manufacturing cost of the image forming apparatus (the multifunction peripheral 100). Further, labor for separate collection of storage circuits can be omitted in disposal of the toner container. In addition, mis-detection of replacement of the toner container by a new one, which may be caused in a configuration with a toner hopper, can be prevented.

The toner sensor 9 outputs a greater output value in response to the magnetic characteristic of the first toner 71 than in response to the magnetic characteristic of the second toner 72. The toner sensor 9 outputs a smaller value when the amount of the toner remaining in the toner replenishment section 8 is small than when the amount of the toner remaining in the toner replenishment section 8 is large. The determination section (the control section 1) detects toner exhaustion indicating that the toner container (the toner cartridge 7) is empty when an output value of the toner sensor 9 is not greater than the predetermined empty value Ve. Upon an output value of the toner sensor 9 increasing to be greater than the empty value Ve after detection of toner exhaustion, the determination section (the control section 1) determines replacement by a new toner container when the output value is greater than the predetermined first threshold value V that is a lower limit value of the first-toner output value range B1, and does not determine replacement by a new toner container when the output value of the toner sensor 9 is not greater than the first threshold value V1. In the above configuration, correct detection as to whether or not replacement by a new toner container is done can be made. Furthermore, replacement by a non-new toner container rather than a new toner container can be detected correctly.

The toner replenishment section 8 connects with the toner container (the toner cartridge 7) through the tubular connection portion 7*a* of the toner container that is partially filled with the first toner 71. In the above configuration, the first toner 71 can be located at a foremost part of a new toner container from which the toner 71 is conveyed toward the toner replenishment section 8. Further, the first toner 71 is present in a part (foremost part) of the tubular connection portion 7*a*. Therefore, even when the toner container is shaken, the first toner 71 can be prevented from being mixed with the second toner 72. In the above configuration, in response to attachment of a new toner container to the image forming apparatus (the multifunction peripheral 100), the first toner 71 can be conveyed first to the toner replenishment section 8 reliably. This can cause the toner sensor 9 to quickly detect the first toner 71 after replacement by a new toner container, thereby achieving quick detection of replacement by the new toner container.

The image forming apparatus (the multifunction peripheral 100) includes the storage section 5 that stores in a non-volatile manner the accumulated toner consumption amount 51 after replacement by a new toner container (a new toner cartridge 7), and the display section 21 that performs display relating to a lifetime of the new toner container. In response to determination of replacement by the new toner container, the determination section (the control section 1) resets the accumulated toner consumption amount 51 to zero and obtains an accumulated toner consumption amount by adding (summing) an amount of toner consumption per page based on the image data for printing to (with) the accumulated toner consumption amount 51. Each time an accumulated toner consumption amount 51 is obtained, the determination section (the control section 1) causes the storage section 5 to update the accumulated toner consumption amount 51 and causes the display section 21 to perform display relating to a lifetime of the new toner container according to the updated accumulated toner consumption amount 51. Thus, correct detection of replacement by a new toner container can be detected and correct information on the lifetime of the toner container (an amount of the toner remaining in the toner container) can be presented to a user.

The image forming apparatus (the multifunction peripheral 100) further includes the communication section 6 that transmits data. In response to the amount of the toner remaining in the toner container (the toner cartridge 7) being the predetermined order value 53, the determination section (the control section 1) causes the communication section 6 to transmit order data on a purchase order for a new toner container to the predetermined transmission target 400. This configuration can cause issuance of a purchase order for a new toner container before printing is disabled due to toner exhaustion. Further, for example, in a situation in which an automatic toner container ordering system is established for ordering a spare toner container based on detection of replacement by a newly-attached toner container, mis-detection of replacement by a new toner container can be prevented. Thus, issuance of an order for a new toner container based on mis-detection can be prevented with a result that a purchase order for an excess number of new toner containers can be prevented.

The first and second toners 71 and 72 that have different magnetic characteristics are separately present as two layers in the toner container (the toner cartridge 7). Thus, when the toner container is applied to an image forming apparatus, the image forming apparatus (the multifunction peripheral 100) can determine replacement by a new toner container simply by monitoring the magnitude of the output value of the toner sensor 9.

Another embodiment will be described next. In the above embodiment, the toner sensor 9 outputs a large value when the magnetic permeability of a detected toner is large. However, the toner sensor 9 may output a small value when the magnetic permeability of the detected toner is large and output a large value when the magnetic permeability of the detected toner is small. In the above configuration, the greater the amount of toner present in the toner replenishment section 8, the smaller the output value of the toner sensor 9. The toner sensor 9 outputs a greater value in toner exhaustion. Further, in the above configuration, in reverse to the above embodiment, the toner sensor 9 outputs a smaller output value in response to the magnetic characteristic of the first toner 71 than in response to the magnetic characteristic of the second toner 72. Specifically, the first toner 71 has a smaller magnetic permeability and a smaller content per unit volume of the magnetic powder than the second toner 72 (the amount of the magnetic powder in the second toner 72 is greater than that in the first toner 71). The first-toner output value range B1 is set as values smaller than the first threshold value V1, and the empty value Ve is set greater than the first threshold value V1.

Embodiments of the present disclosure have been described so far. However, the present disclosure is not limited to the above embodiments and various alterations can be made to the above embodiments within the scope not deviating from the essence of the present disclosure.

What is claimed is:

1. An image forming apparatus comprising:

a development section that develops an electrostatic latent image using toner;

a toner replenishment section that receives toner supply from a toner container and conveys received toner toward the development section;

a toner sensor that outputs a value that varies depending on an amount of a toner remaining in the toner replenishment section and a magnetic characteristic of the toner; and a determination section that determines according to an output value of the toner sensor whether or not an existing toner container is replaced by a new toner container, wherein the new toner container is filled with a first toner and a second toner that have different magnetic characteristics, once attached to the image forming apparatus, the new toner container supplies the first toner to the toner replenishment section prior to the second toner and the toner sensor outputs an output value within a first-toner output value range that is a range of an output value of the toner sensor in response to the magnetic characteristic of the first toner, and upon the output value of the toner sensor changing from a value out of the first-toner output value range to a value within the first-toner output value range, the determination section determines replacement by the new toner container.

2. The image forming apparatus according to claim 1, wherein the toner sensor outputs a greater output value in response to the magnetic characteristic of the first toner than in response to the magnetic characteristic of the second toner, the toner sensor outputs a smaller value when the amount of the toner remaining in the toner replenishment section is small than when the amount of the toner remaining in the toner replenishment section is large, when an output value of the toner sensor is not greater than a predetermined empty value, the determination section detects toner exhaustion indicating that the toner container is empty, and upon an output value of the toner sensor increasing to be greater than the empty value after detection of toner exhaustion, the determination section determines replacement by the new toner container when the output value is greater than a predetermined first threshold value that is a lower limit of the first-toner output value range, and does not determine replacement by the new toner container when the output value of the toner sensor is not greater than the first threshold value.

3. The image forming apparatus according to claim 1, wherein the toner replenishment section connects with the new toner container through a tubular connection portion of the toner container that is partially filled with the first toner.

4. The image forming apparatus according to claim 1, further comprising:

a storage section that stores in a non-volatile manner an accumulated amount of toner consumption after replacement by the new toner container; and a display section that performs display relating to a lifetime of the new toner container, wherein in response to determination of replacement by the new toner container, the determination section resets the accumulated amount of toner consumption to zero and obtains an accumulated amount of toner consumption by adding an amount of toner consumption per page based on image data for printing to the accumulated amount of toner consumption, and each time an accumulated amount of toner consumption is obtained, the determination section causes the storage section to update the accumulated amount of toner consumption and causes the display section to perform display relating to a lifetime of the new toner container according to the updated accumulated amount of toner consumption.

5. The image forming apparatus according to claim 1, further comprising a communication section that transmits data, wherein in response to an amount of the toner remaining in the new toner container being a predetermined order value, the determination section causes the communication section to transmit order data on a purchase order for a new toner container to a predetermined transmission target.

* * * * *